US010978826B2

(12) United States Patent
Li et al.

(10) Patent No.: US 10,978,826 B2
(45) Date of Patent: Apr. 13, 2021

(54) ELECTRICAL CONNECTOR ASSEMBLY HAVING A MAGNET AND HEAT INSULATION OR WATERPROOF FEATURE AND ASSEMBLING METHOD OF THE SAME

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yong-Qi Li, Kunshan (CN); Jian-Hui Tan, Kunshan (CN); Jun Chen, Kunshan (CN); Yang-Tsun Hsu, New Taipei (TW); Jerry Wu, Irvine, CA (US)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/714,806

(22) Filed: Dec. 16, 2019

(65) Prior Publication Data

US 2020/0194929 A1 Jun. 18, 2020

(30) Foreign Application Priority Data

Dec. 14, 2018 (CN) ..... 201811533911.5

(51) Int. Cl.
*H01R 13/62* (2006.01)
*H01R 13/52* (2006.01)

(52) U.S. Cl.
CPC ..... *H01R 13/6205* (2013.01); *H01R 13/5213* (2013.01)

(58) Field of Classification Search
CPC ..... H01R 13/6205; H01R 13/5213
See application file for complete search history.

(56) References Cited

U.S. PATENT DOCUMENTS

| | | | | |
|---|---|---|---|---|
| 7,311,526 | B2 | 12/2007 | Rohrbach et al. | |
| 9,083,112 | B2 * | 7/2015 | Asai | H01R 13/6205 |
| 9,419,377 | B2 | 8/2016 | Zhu et al. | |
| 9,755,355 | B2 | 9/2017 | Schwalbach et al. | |
| 9,837,750 | B2 | 12/2017 | Wu et al. | |
| 9,941,627 | B2 | 4/2018 | Esmaeili et al. | |
| 2010/0303424 | A1 * | 12/2010 | Furuyama | G02B 6/43 385/92 |
| 2013/0157499 | A1 * | 6/2013 | Crippen | H01R 12/724 439/487 |

(Continued)

*Primary Examiner* — Abdullah A Riyami
*Assistant Examiner* — Nader J Alhawamdeh
(74) *Attorney, Agent, or Firm* — Wei Te Chung; Ming Chieh Chang

(57) ABSTRACT

An electrical connector assembly includes an insulative housing, a plurality of terminals mounted on the insulative housing, a cable electrically connected with the terminals, a magnet disposed on the insulative housing, and an inner mold integrally formed on the insulative housing and the cable, wherein the electrical connector assembly also includes a heat insulation member disposed between the magnet and the inner mold to prevent the magnet from heat of the inner mold during molding.

14 Claims, 6 Drawing Sheets

(56) References Cited

U.S. PATENT DOCUMENTS

| | | | | |
|---|---|---|---|---|
| 2014/0148018 | A1* | 5/2014 | Kim | H01R 11/30 439/39 |
| 2014/0322929 | A1* | 10/2014 | Asai | H01R 11/30 439/39 |
| 2020/0194929 | A1* | 6/2020 | Li | H01R 13/5213 |

* cited by examiner

ELECTRICAL CONNECTOR ASSEMBLY HAVING A MAGNET AND HEAT INSULATION OR WATERPROOF FEATURE AND ASSEMBLING METHOD OF THE SAME

BACKGROUND OF THE DISCLOSURE

Field of the Disclosure

The present disclosure relates to an electrical connector assembly and assembling method of the same, in particular to an electrical connector assembly with a heat insulation member.

Description of Related Arts

In an electrical connector assembly using injection molding operation to cover and fix various components thereof, temperature of the injection molding operation is too high such that a magnetic component, e.g., magnet, of the electrical connector assembly may be demagnetized.

Therefore, an improved electrical connector assembly is desired.

SUMMARY OF THE DISCLOSURE

Accordingly, an object of the present disclosure is to provide an electrical connector assembly with a heat insulation member between the magnet and inner mold to prevent the magnet from heat of the inner mold during molding.

To achieve the above object, an electrical connector assembly includes an insulative housing, a plurality of terminals mounted on the insulative housing, a cable electrically connected with the terminals, a magnet disposed on the insulative housing, and an inner mold integrally formed on the insulative housing and the cable, wherein the electrical connector assembly includes a heat insulation member disposed between the magnet and inner mold to prevent the magnet from being heated during molding the inner mold.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
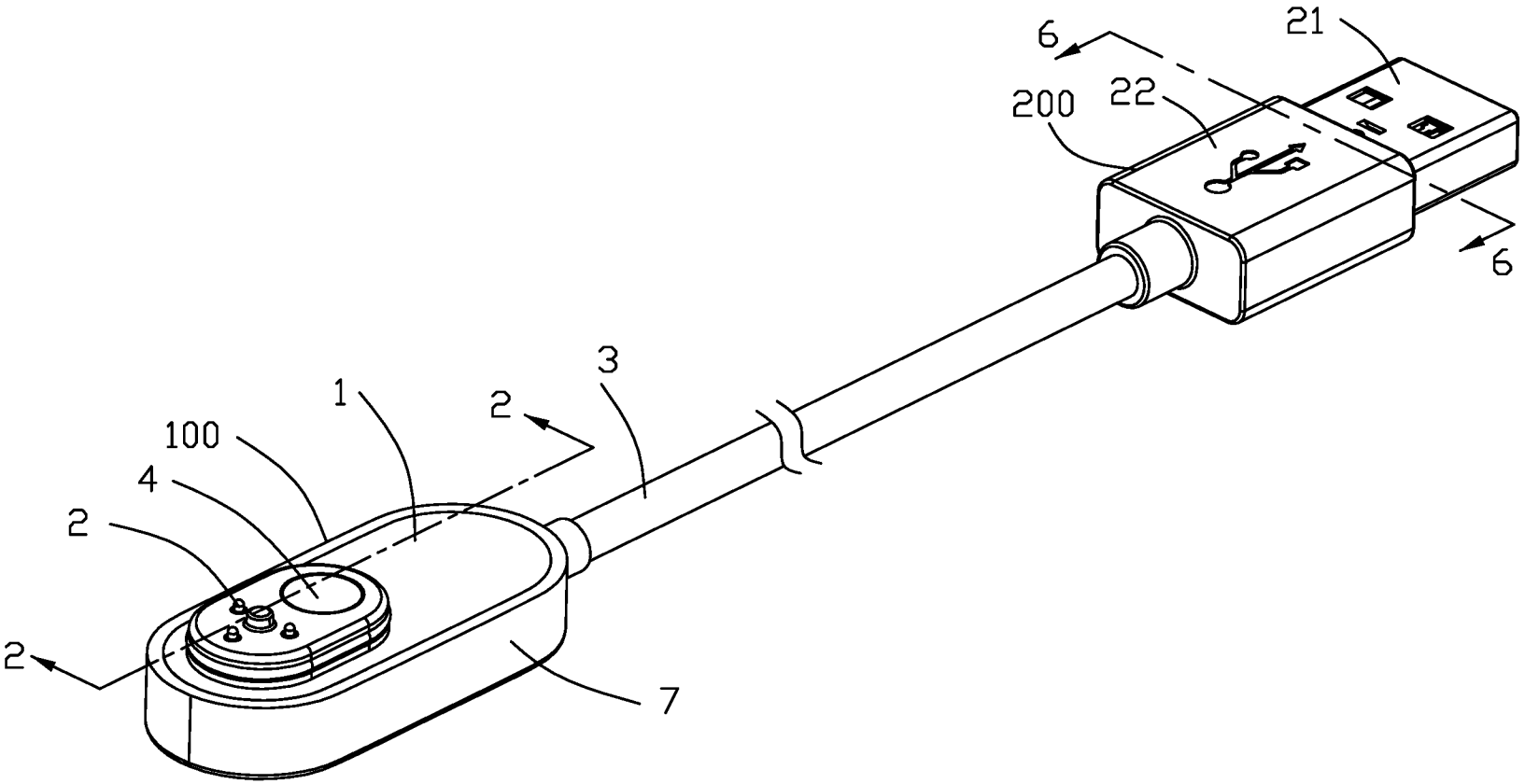
FIG. 1 is a front view of an electrical connector assembly according to the present invention.
Figure 2:
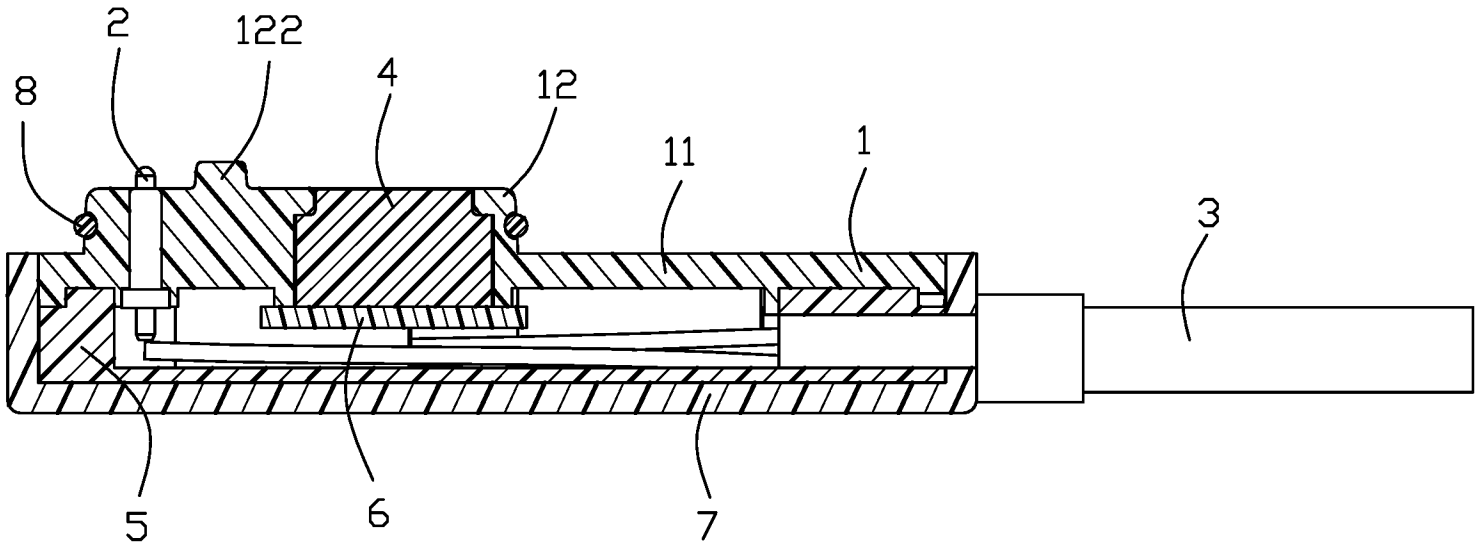
FIG. 2 is a cross-sectional view of the electrical connector assembly taken along line 2-2 in FIG. 4.
Figure 3:
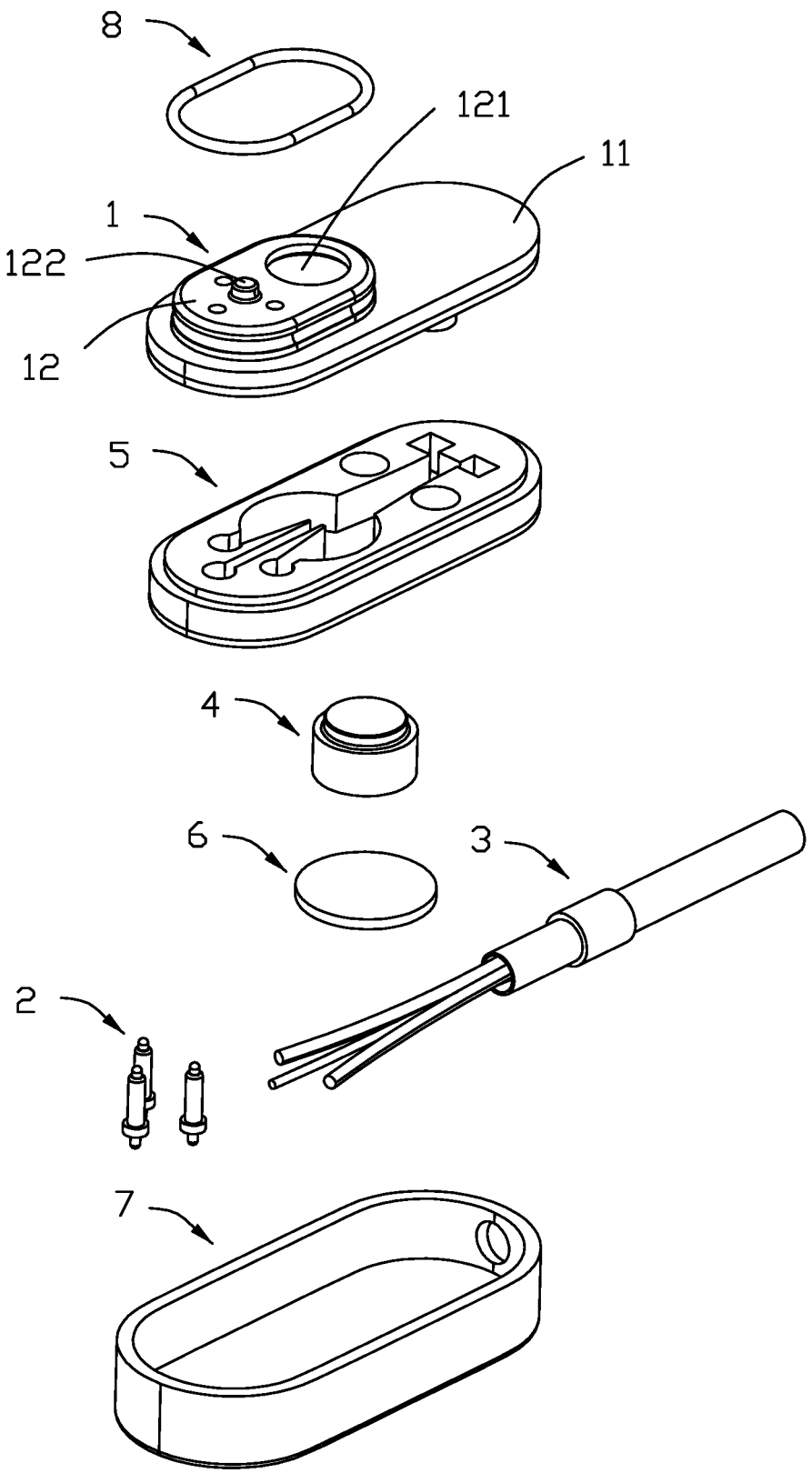
FIG. 3 is an exploded view of the electrical connector assembly as shown in FIG. 1.
Figure 4:
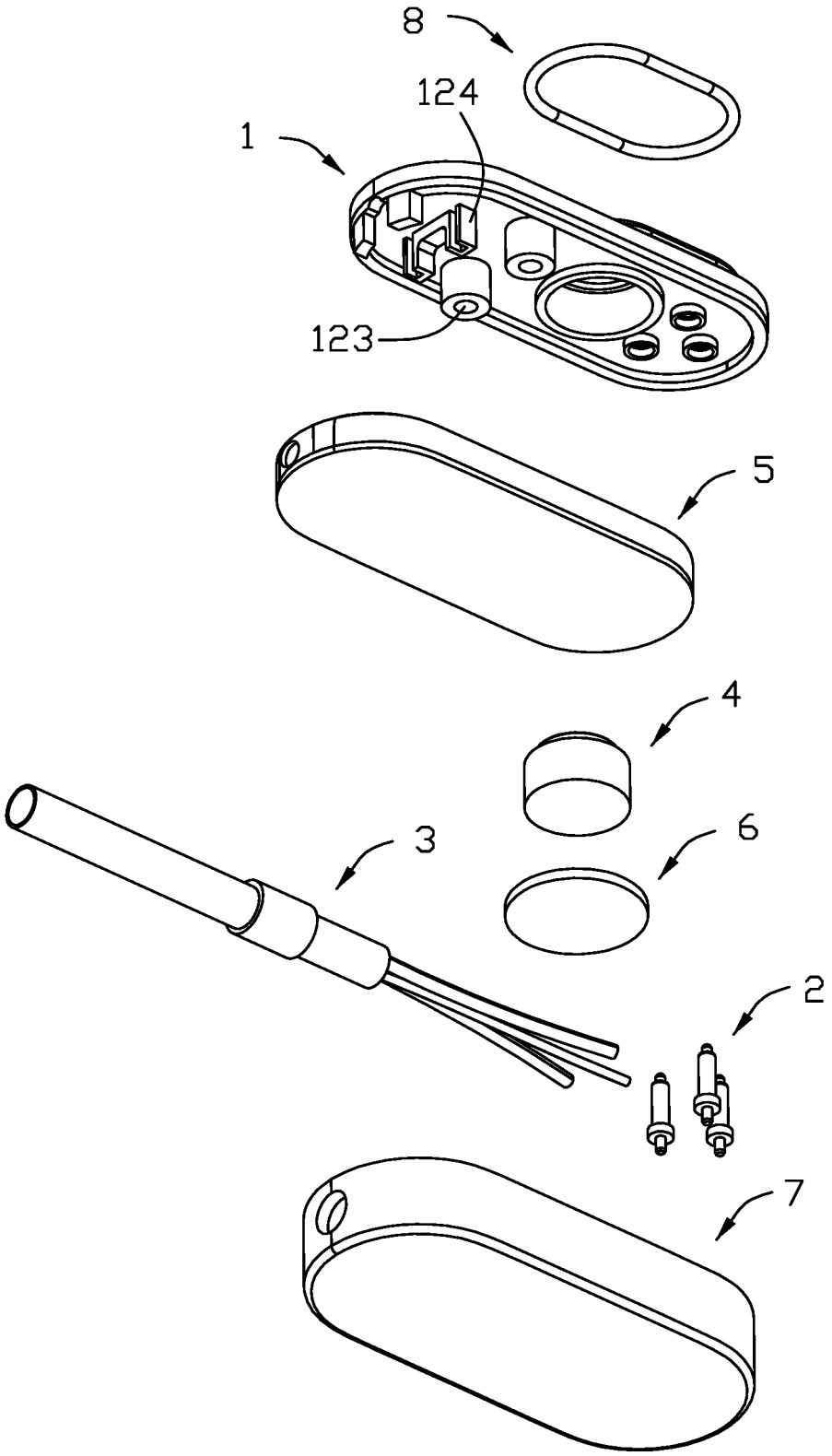
FIG. 4 is another exploded view of the electrical connector assembly as shown in FIG. 1.

Reference will now be made in detail to the embodiments of the present disclosure.

Referring to FIGS. 1-4, an electrical connector assembly 100 according to an embodiment of the present invention includes an insulative (upper) housing 1, a plurality of terminals 2 mounted on the insulative housing 1, a cable 3 connected with the terminals 2, a magnet 4 mounted on the insulative housing 1, an inner mold 5 integrally formed on the insulative housing 1 and the cable 3, a heat insulation member 6 disposed between the magnet 5 and inner mold 5, and an outer mold 7 covering the inner mold 5 and insulative housing 1. Notably, for the purpose of illustration and not limitation, the terminals 2 include three retractable terminals arranged in a triangular shape in this invention. In this invention, the terminals 2 are directly and electrically connected to the cable 3, e.g., soldering. The terminals 2 and the cable can also be connected indirectly through, for example, a printed circuit board.

The insulative housing 1 includes a base portion 11, a protruding portion 12 extending from one side of the base portion 11 with a mating surface (not labeled) thereon, a fixing post 123 extending from the other side opposite to one side of the base portion 11, and a slot 124 extending from the other side opposite to one side of the base portion 11. A waterproof ring 8 is provided on the outside of the protruding portion 12. When the electrical connector assembly 100 is mated with an external connector, the waterproof ring 8 is closely mated with the external connector to prevent liquid from entering and affecting the electrical performance of the electrical connector assembly 100. The protruding portion 12 includes a positioning post 122 extending outwardly therefrom and beyond the mating surface of the protruding portion 12. When the electrical connector assembly 100 is mated with an external connector, the terminals 2 extending beyond the mating surface are assisted in positioning and mating with the external connector. The fixing post 123 is used to enhance the bonding force with the inner mold 5. The slot 124 fixes the cable 3 to improve the molding yield of the inner mold 5. The insulative housing 1 also includes a receiving hole 121 extending through the base portion 11 and the protruding portion 12. The magnet 4 is received in the receiving hole 121 with the corresponding coupling face (not labeled) coplanar with the mating surface of the protruding portion 12, and the heat insulator 6 covers the magnet 4 to prevent the magnet 4 from being affected by the heat of the inner mold 5 when the inner mold 5 is molded. In this embodiment, the heat insulation member 6 is an EPDM (Ethylene-Propylene-Diene Monomer) insulation foam, and may also be made of materials such as EPP (Expanded Polypropylene), PU (Polyurethane), XPE (Chemical Crosslinked Polyethylene)/IXPE (Irradiation Crosslinked Polyethylene), and EVA (Ethylene Vinyl Acetate).

Figure 5:
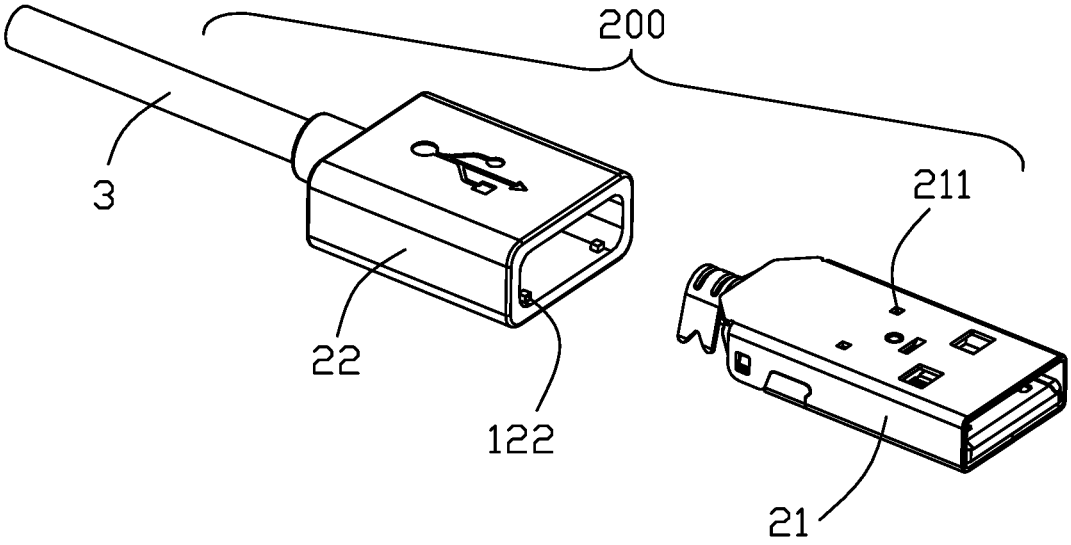
FIG. 5 is an exploded view of a USB plug of the electrical connector assembly as shown in FIG. 1.
Figure 6:
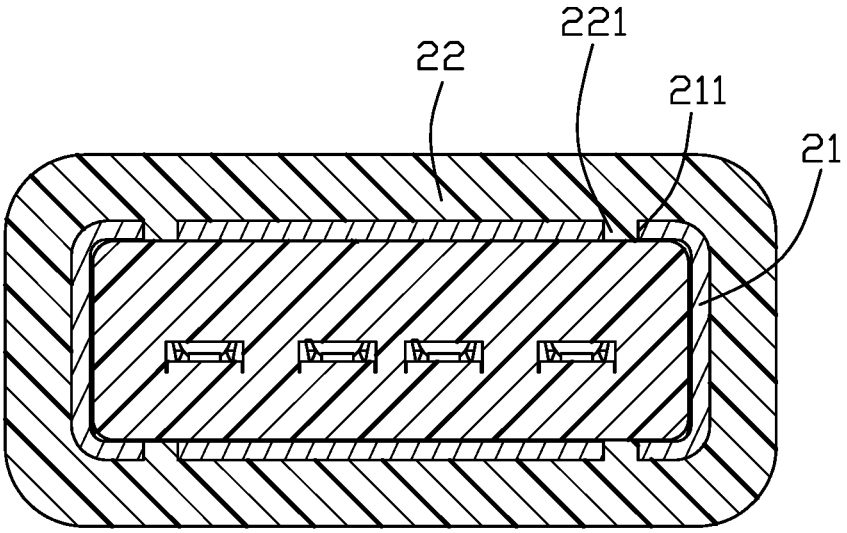
FIG. 6 is a cross-sectional view of the USB plug of the electrical connector assembly taken along line 6-6 in FIG. 1.

Referring to FIGS. 5-6, for the purpose of illustration and not limitation, in this embodiment, the other end of the electrical connector assembly 100 is a USB plug 200. The USB plug 200 includes metal shell 21 and a plastic case 22 covering the metal shell 21. Both sides of the metal shell 21 have a plurality of receiving holes 211, and the plastic case 22 is provided with a projection 221 cooperating with the receiving holes 211, thereby enhancing the binding force between the plastic casing 22 and the metal shell 21. In this embodiment, the positioning post 122 provides alignment so as to assure the correct relative positions of the terminals 2 and the corresponding contacts of the external connector while the magnet 4 provides attraction between the external connector and the protruding portion 12 so as to assure the retention between the terminals 2 and the corresponding contacts of the external connector. In this embodiment, the positioning post 122 is located within the triangle boundary defined by the three terminals 2, and the magnet 4 is closely located beside such a triangle boundary. In this embodiment, such a triangle is an isosceles triangle and the positioning post 122 is located at the midline thereof. In addition, the inner mold 5 can be essentially a lower housing pre-forming passages to allow the corresponding wires of the cable 3 to extend toward and connect to the corresponding terminals 2.

What is claimed is:

1. An electrical connector assembly comprising:

an insulative housing;

a plurality of terminals mounted on the insulative housing;

a cable electrically connected with the terminals;

a magnet disposed on the insulative housing;

an inner mold integrally formed on the insulative housing and the cable; and a heat insulation member disposed between the magnet and the inner mold.

2. The electrical connector assembly as claimed in claim 1, further including an outer mold covering the inner mold and the insulative housing.

3. The electrical connector assembly as claimed in claim 1, wherein the insulative housing includes a base portion and a protruding portion extending from one side of the base portion.

4. The electrical connector assembly as claimed in claim 3, wherein the protruding portion includes a positioning post extending outward from the protruding portion.

5. The electrical connector assembly as claimed in claim 3, wherein the insulative housing includes a fixing post extending from the other side opposite to the one side of the base portion.

6. The electrical connector assembly as claimed in claim 1, further including a waterproof ring provided on an outside of the protruding portion of the insulative housing.

7. The electrical connector assembly as claimed in claim 1, wherein the insulative housing includes a slot for receiving the cable.

8. The electrical connector assembly as claimed in claim 1, wherein the terminals are retractable terminals.

9. A method of assembling an electrical connector assembly, comprising the steps of:

mounting a plurality of terminals to an insulative housing;

connecting a cable with the terminals;

disposing a magnet on the insulative housing;

covering the magnet by a heat insulation member; and forming an inner mold on the insulative housing and the cable to insulate heat from affecting the magnet.

10. The method as claimed in claim 9, wherein the step of connecting comprises directly soldering the cable to the terminals.

11. An electrical connector assembly comprising:

an insulative upper housing forming a protruding portion with a mating surface thereon;

a plurality of retractable terminals retained in the insulative housing and extending out of the mating surface;

a magnet disposed in the protruding portion of the insulative housing and adjacent to said terminals with a coupling face coplanar with the mating surface of the protruding portion;

an insulative lower housing located under the insulative upper housing;

a waterproof ring surrounding the protruding portion; and a cable mechanically and electrically connected to the terminals and retained between the upper housing and the lower housing; wherein a positioning post is formed within an area with a boundary defined by the terminals, and said positioning post extends beyond the mating surface;

the protruding portion is of a stadium configuration; and the magnet occupies around one half of the protruding portion.

12. The electrical connector assembly as claimed in claim 11, wherein the terminals commonly form a triangle.

13. The electrical connector assembly as claimed in claim 12, wherein said triangle is an isosceles, and the positioning post is locate at a midline thereof.

14. The electrical connector assembly as claimed in claim 11, wherein an area within a boundary defined by the terminals occupies the other half of the protruding portion.

* * * * *